US006224241B1

(12) United States Patent
Oswald

(10) Patent No.: US 6,224,241 B1
(45) Date of Patent: May 1, 2001

(54) LIGHTING DEVICE

(76) Inventor: Willi Wolfgang Oswald, Lettenbündte 10+12, D-79739 Schwörstadt (DE)

( * ) Notice: Subject to any disclaimer, the term of this patent is extended or adjusted under 35 U.S.C. 154(b) by 0 days.

(21) Appl. No.: 09/214,315

(22) PCT Filed: Jan. 7, 1997

(86) PCT No.: PCT/EP97/03414

§ 371 Date: Jan. 4, 1999

§ 102(e) Date: Jan. 4, 1999

(87) PCT Pub. No.: WO98/00671

PCT Pub. Date: Jan. 8, 1998

(30) Foreign Application Priority Data

Jul. 1, 1996 (DE) ..... 296 11 401 U
Sep. 16, 1996 (DE) ..... 296 16 020 U

(51) Int. Cl.[7] ..... F21V 29/00

(52) U.S. Cl. ..... 362/267; 362/368; 362/375; 362/378

(58) Field of Search ..... 362/145, 147, 362/153.1, 368, 374, 375, 376, 378, 364

(56) References Cited

U.S. PATENT DOCUMENTS 3,370,165 * 2/1968 Chan ..... 362/364
3,376,413 * 4/1968 Peter ..... 362/145
4,388,674 * 6/1983 Sano ..... 362/376
4,398,237 * 8/1983 Doyel ..... 362/374
5,034,869 * 7/1991 Choi ..... 362/147
5,567,041 * 10/1996 Slocum ..... 362/375

FOREIGN PATENT DOCUMENTS 961012 3/1957 (DE) .
1157703 9/1961 (DE) .
8911879 1/1990 (DE) .
9204941 8/1992 (DE) .
9304052 9/1993 (DE) .
956714 * 2/1979 (FR) .
815424 6/1959 (GB) .
2246425A 1/1992 (GB) .
54-026085 * 2/1979 (JP) .

* cited by examiner

*Primary Examiner*—Alan Cariaso
*Assistant Examiner*—Ronald E. DelGizzi
(74) *Attorney, Agent, or Firm*—Venable; George H. Spencer; Robert Kinberg

(57) ABSTRACT

A lighting device has a light holder positionable on a mounting support, the light holder also having an outer light holder edge. The light holder includes a centrally located light holder top that projects from the mounting support for fastening a light source. A light protector is detachably fastened on the light holder. The light protector covers the light source and any holder regions projecting from the mounting support in such a way that essentially only the light protector is visible. The light protector has a protector collar, which encircles the outer holder edge and limits a protector opening that is pointed toward the inside space defined by the light protector.

14 Claims, 9 Drawing Sheets

LIGHTING DEVICE

BACKGROUND OF THE INVENTION

The invention relates to a lighting device, having a light holder for attaching a light source and a light protector that is fastened detachably thereon. Such a lighting device is known from the DE-AS 1 157 703.

A lighting device is furthermore known from the DE-U-8 911 879, the light protector of which contains several slits for allowing the light beams, emitted by the light source, to escape. Additional parts of the lighting device, which are accessible from the outside, are arranged in the region of these slits for the emerging light. These include, for example, optical lenses and fastening screws used to secure the light protector to the light holder. The disadvantage of this lighting device is that it requires an involved production technology to dimension the slits in the light protector through which the light emerges, so that the fastening means for the light protector are accessible for assembly. The structural design makes the lighting device susceptible to damage and the effects caused by weather conditions. An additional disadvantage is the complicated design of the individual parts, as concerns the structure and assembly technology.

SUMMARY OF THE INVENTION

It is the object of the invention to specify a lighting device that can be used on the inside as well as the outside and which is additionally protected.

This object is solved with the combination of features described herein. In accordance with the invention, the holder regions of the lighting device, which project in the assembled state from the mounting support, and the light source that also projects from the mounting support, as well as additional parts arranged on the light holder, if necessary, are covered such that in the assembled state, essentially only the light protector or the surface of the protector wall that is effective as the actual covering is visible. In particular, the light protector when in the assembled state encases the state covers completely or at least nearly completely the lighting device components, which project from the mounting support.

The complete covering of the light holder regions projecting from the mounting support is realized in that the light protector encircles an outer light holder edge with a protector collar facing the mounting support, that is in the circumferential direction extending crosswise to its longitudinal axis. The edge of the light holder preferably projects over the mounting support and thus becomes effective as seal for the inside space of the lighting device. The protector collar limits a central opening in the light protector, designed to accommodate the light holder regions and the light source that project from the mounting support. It is preferable if the protector collar is formed as one piece with the finished light protector. The protector collar preferably encircles the light holder edge in a form-fitting manner or flush. In that case, the light holder edge becomes additionally effective as centering aide when fitting the light protector onto the light holder, thus further simplifying the expert mounting of the lighting device. This form-locking installation furthermore provides a sealing of the inside space of the lighting device, which is sufficient in many cases.

A complete sealing of the light holder region positioned outside of the mounting support is supported by a fitting ridge that is formed onto the protector collar, flanks the light holder edge, and in particular surrounds it form-fittingly or flush. The fitting ridge, which points toward the inside space of the light protector in the region of the protector opening, permits a good discharge of forces attacking the light protector, in particular its outside surface. The fitting ridge that is pointed toward the inside furthermore does not lead to a detraction of a desired three dimensional shape of the light protector in the assembled state, which is visible from the outside.

In this way, the light protector ensures, without requiring additional parts, a particularly effective protection for the individual components of the lighting device against mechanical damage, wear and tear, weather-related influences, as well as possible electrical danger sources, thereby promoting a long service life for the lighting device. Thus, means for locally securing the position of the lighting device on the mounting support, for example, are completely screened and are effectively protected against corrosion or other material wear and tear, as well as any undesirable dismantling. In any case, the light protector covers those regions of the light holder and the light source which are otherwise accessible from the outside against the outside, thereby resulting in a particularly good protection and sealing effect for the sensitive parts of the lighting device.

The wall areas of the light protector, which are effective as the actual covering, are normally free of perforations. It is preferable if the light protector is adapted structurally to the light holder in such a way that the light protector when assembled accommodates the lighting device components that must be covered through an opening in the protector and that the opening edge of the protector opening is tangent to the mounting surface of a mounting support. In this way, essentially only the light protector is visible. This is achieved, for example, in that the light protector or its opening edge in the assembled state fits flush against the mounting surface. In another embodiment, the light protector slightly penetrates the mounting support (e.g. with a liquid as mounting support). The invention also includes the option that in order to ensure a necessary movement allowance of the light protector, relative to the mounting surface, the opening edge is arranged at a slight distance tangent to the mounting surface, so that a non-damaging assembly of the light protector is possible and the light protector can be placed into the desired mounting position without interference, even if the mounting surface is uneven. Since the structural height corresponding to this mounting movement play, which is possibly not covered, . . . is ensured in these cases as well that essentially only the light protector is visible in the assembled state and that the remaining components of the lighting device are essentially covered completely. In addition, the covering effect of the light protector is supported by the mounting surface (e.g. grass, earth) itself, particularly if the mounting support is uneven, so that as a result of the aforementioned movement play for the light protector assembly, any regions that may be exposed are covered by these unevennesses that surround the light holder.

The mounting support is understood to include all those mounting units or mounting backgrounds, which permit a sufficiently stable positioning of the lighting device when in the assembled and operating state. The positioning of the lighting device here can be supported at the mounting support with additional fastening means. Suitable for this is a relatively solid mounting support, e.g. an exterior wall, a room ceiling, or an interior wall. The light holder can be inserted into this mounting support or fitted onto the surface of this mounting support, wherein the light source projecting over the mounting surface and any projecting holder regions are protected by the light protector. Other supports suitable for mounting are, for example, the earth or a liquid into which the light holder is placed as a floating element. Of course, the material for the light holder used as floating element must be selected such that its specific weight is less than the specific weight of the respective liquid. Furthermore, this "floating" lighting device is designed to be impervious to liquid by using suitable auxiliary means.

Since the visible portion of the lighting device in the assembled state is essentially reduced to the luminous surface only, meaning to the visible surface of the light protector, this type of lighting device is therefore particularly suitable for an elegant installation in the landscape, e.g. in public gardens, running/standing water or in pond systems. When using lighting devices as floating elements, the surface of the liquid serves as mounting support.

The light holder and the light protector are designed and assembled in such a way that the light holder and the contained structural components, as well as the possibly auxiliary mounting means, e.g. fastening screws, for mounting it on the mounting support, are not visible from the outside once the lighting device is fully assembled. In this way, it is essentially only the light-permeable light protector that is visible in the assembled state of the lighting device. The fact that the other structural components of the lighting device are not visible provides an elegant appearance in the assembled state.

Since only the light protector is necessary as protective covering, this lighting device can be used either on the inside or on the outside in closed accommodations and requires little expenditure for the assembly.

One preferred embodiment provides that the light holder can be inserted at least partially into the mounting support during the assembly of the lighting device. In this way, the production and shaping of the light protector remains independent of varied assembly requirements and design heights of the light holder. This permits a universal use of the same type of light protector for light holders with varied dimensions. As a result of this, the assortment of parts for the various lighting devices as well as the costs can be kept advantageously low. The light holder is inserted, for example, into the earth, into a garden pond or other container with liquid. The earth surface or the surface of the liquid serve as a mounting surface. In those cases, the mounting support surrounding the light holder (e.g. earth, liquid) already provides a sufficiently stable positioning and fastening of the lighting device. The mounting support at the same time provides an additional protection against damage to the light holder and possibly therein contained parts.

The design height of the light holder is adapted to the varied installation conditions. A relatively low design height for fastening the light holder is used for a solid mounting support (e.g. a sidewalk, a wall). In that case, several fastening screws penetrate the light holder to connect it securely to the mounting support. Given a relatively soft or lose mounting support or underground (e.g. earth, water) or if the mounting support contains a compartment for receiving the light holder, then a higher design for the light holder is desirable to allow for a stable positioning of the light holder in the mounting support. The greater part of this higher light holder is inserted into the background material in order to stabilize it, whereas the region of the light holder that projects over the mounting surface (e.g. earth, water level) is covered in the assembled state by the light protector, as described in the above. In the case of earth, water or filler material surrounding this comparatively high light holder design, this material replaces the fastening screws. As a result of the great design height of the light holder, its center of gravity is below the mounting surface (inside of the mounting support), so that the light holder is positioned non-tilting in the mounting support, solely with the aid of the aforementioned earth or filler material.

The total aesthetic appearance of the lighting device can be improved through a corresponding design of the light protector. The light protector for one preferred embodiment is rotation symmetrical, e.g. it has a sphere-shaped or cylindrical design. Furthermore, an eggshell-shaped embodiment with rotation symmetrical light protector is also conceivable. In particular the sphere-shaped and the eggshell-shaped design of the light protector permit a good elimination of the forces effecting the light protector from the outside, thus providing additional protection against damage to the lighting device.

The light protector of another preferred embodiment has a polygonal design. Light protectors with polygonal as well as rotation-symmetrical designs can have a conically tapered shape in the direction of the side facing away from its mounting surface, thus promoting an interesting appearance for the lighting device.

The light protector is made of a stable, sufficiently light-permeable material, e.g. from a plastic with stability of shape. The light protector can be manufactured particularly cost-effectively from an environment-friendly polyethylene (PE).

The light holder preferably is composed of a mechanically stable, electrically insulating plastic (e.g. PE). The low weight of the light holder made of plastic helps with an easy positioning, transport and assembly of the lighting device. This also provides excellent protection for the supply lines, extended through the light holder, as well as for the electrical components for connecting an electrical light source.

One advantageous embodiment provides that the light protector in the finished state is formed as one piece. At the start of the production, the light protector can consist of several individual pieces that are joined to form one piece, e.g. by welding them together. In any case, the parts subsequently form a one-piece light protector. The one-piece light protector facilitates the handling and assembly of the lighting device and avoids leaks in the protection for the light holder and the light source.

With respect to production technology, the light holder is essentially a rotation-symmetrical part with circular cross section. It makes sense if the structural shape of the light holder has a cylinder-shaped or cone-shaped design. A cylinder-shaped outside casing of the light holder serves as a good means for securing and guiding the light protector when fitting it onto the light holder. A cone-shaped or truncated cone-shaped outside casing for the light holder offers a particularly good stabilization when using the lighting device as a floating lighting device, owing to the gyroscopically favorable center of gravity. A rotation-symmetrical design of the light protector, e.g. as a hollow sphere, facilitates the assembly, as well as supports the stabilization effect.

If the lighting device is used as a floating lighting device, its stable, non-tilting position for one advantageous embodiment is improved in that the cross section of a cone-shaped or truncated cone-shaped light holder is tapered in the direction of the side that faces away from the light protector in axis-longitudinal direction.

The sealing of the lighting device for one preferred embodiment is improved in that the protector collar form-fittingly encircles the light holder with at least one sealing element inserted inbetween.

In one preferred embodiment, the seal for the lighting device is improved in that the protector collar encircles the holder edge in a form-locking manner, with at least one sealing element inserted between them, thus resulting in a particularly effective sealing of the lighting device against moisture and other effects caused by weather conditions. Owing to its material qualities, the sealing element also advantageously prevents any undesirable position changes of the light protector after it is installed. The sealing element is preferably formed as self-contained part and is pre-secured either at the light holder edge or the protector collar. This results in an exact seating of the sealing element. A multitude of commercially available and therefore cheap ring seals can be used for example, as sealing elements.

In order to further simplify the assembly of the light protector, a screw connection is provided for one preferred embodiment between the light protector and the light holder. A thread is arranged or formed onto the light holder for this, so that the light protector with complementary protector thread is simply screwed on. For this, the light protector is turned in circumferential direction. This screw connection permits a structurally simple and simultaneously mechanically stable connection between the light protector and the light holder. Prior to screwing on the light protector, the light holder thread is effective so-to-speak as centering aide for an expert mounting of the light protector and makes a correct assembly possible, even for an inexperienced person. The covering by the light protector is obtained automatically when screwing the parts together. For the purpose of a space-saving design, it is advantageous if the thread on the protector is arranged on the inside of the light protectors. The thread on the protector is thus well protected against damage during transport and storage of the light protector. The handling of the light protector is also simplified by this.

Additional preferred embodiments provide for a bayonet catch, in particular a push-and turn-lock, a latch, or the like to establish a mechanically stable and at the same time detachable connection between the light protector and the light holder as alternative to the aforementioned screw-together seal. Sealing connections of this type are also easy to handle with respect to assembly technology.

The holder thread is preferably located in the center, meaning the region of the center longitudinal axis or the symmetry axis of the light holder, to make the screw-in operation easier and keep the design of the light protector and the light holder simple.

The holder thread preferably is an outside thread that operates jointly with a complementary inside thread of the light protector. As a result of the three dimensional shape of the light protector, it is advantageous if the protector thread is an inside thread. In that case, the protector thread can be secured through suitable fastening means to the wall of a light protector without this hindering the screw-together operation. The fastening means, which are effective between the light protector wall and thread simultaneously allow for a mechanically stable fixing of the protector thread.

In one advantageous embodiment, the holder thread is a component of a cylindrical holder top, which preferably extends past the holder edge, thus making it easier to screw on the light protector. The cylindrical shape of the holder top makes it possible to use either the outside surface or the inside surface of a holder top casing, which is hollow-cylindrical in this case, for forming on the holder thread, depending on the requirement. As a result of this, the holder top in this case becomes advantageously effective as additional assembly aide, that is to say as a centering mandrel for fitting on the light protector. The holder top in particular is formed as one piece together with the light holder, thereby promoting a secure positioning of the light protector that is screwed together with the holder top.

In order to attach the protector thread to the light protector, one advantageous embodiment provides for the use of a connecting crosspiece or several strut-like connecting crosspieces, which extends (extend) approximately crosswise to the circumferential direction of the light protector and connect the protector thread with the inside surface of the protector wall or the protector collar, in particular with its fitting ridge. It is preferable if the connecting crosspiece is an integral component of the light protector. The angled connecting region between the protector collar and the connecting crosspiece make it easier to discharge forces acting from the outside onto the light protector surface. The protector collar and the connecting crosspiece therefore improve the mechanical inherent stability of the light protector and the total lighting device.

One advantageous embodiment provides that the protector thread is connected to the connecting crosspiece in the region of its thread end, which axially faces the light holder, thereby making it possible to reduce the required design height of the light protector, if necessary, without reducing its functionality. This connecting crosspiece arrangement furthermore promotes a stable positioning of the protector thread, designed as inside thread, during the screw motion.

In order to improve the inherent stability of the connecting crosspiece, a preferred embodiment of this crosspiece is designed to be self-contained in circumferential direction of the light protector. Such a connecting crosspiece additionally supports the inherent stability of the light protector and a stable arrangement of the protector thread. Furthermore, this connecting crosspiece advantageously serves as mechanical and, if necessary, electrical protection for structural components that are arranged on the light holder, e.g. for electrical supply lines, electrical contact points etc. In addition, this connecting crosspiece effects an optical screening in that the intended lighting effect of the light protector is not reduced by the light holder and the thereon arranged components. It is preferable if the connecting crosspiece is arranged at a distance to the light holder surface, so that a protected receiving channel for the aforementioned electrical connection elements and, if necessary, further structural components is created between the connecting crosspiece and the light holder. The connecting crosspiece can be adapted to different volume requirements of the receiving channel by providing it with a specific geometric cross-sectional design, e.g. in the shape of a line or steps.

The lighting device in particular can be connected to an electrical energy supply source, such that the light source is an electrically operated component. Such light sources, e.g. incandescent lights, economy lights, and the like can be obtained cheaply on the market owing to the fact that they are mass-produced.

In order to make it easier technically to install the light source inside the lighting device, the light source is designed such that in order to make electrical contact, the light source preferably operates jointly with a contact socket that is attached to the light holder, in particular it is screwed together with a thread-type contact socket. Such contact sockets are also commercially available, are cheap and make it easy to provide the light holder with electricity via an external cable connection.

The contact socket for one advantageous embodiment is attached with suitable means to the holder top, is arranged centered to the holder thread that is formed onto the casing surface and is effective as outside thread. This structural design creates a compact and space-saving configuration of the light holder and advantageously reduces the total volume of the lighting device.

The light holder for one advantageous embodiment has at least one receiving channel for accommodating an electrical line, serving as electrical connection between the light source and the external connecting cable. A detachable contacting connection (e.g. a luster terminal) preferably exists between the line and the connecting cable. The section-by-section configuration of the electrical connection makes it possible to replace individual components only in case of a defect, which raises the value for keeping this lighting device. The error detection is furthermore made easier in case of defects.

BRIEF DESCRIPTION OF THE DRAWINGS

Exemplary embodiments of the invention are explained in further detail with the aid of the drawings, wherein.

In the embodiments shown, components that function in the same way and structural arrangements with identical function are provided with the same reference numerals to avoid repeating the description.

DETAILED DESCRIPTION OF THE DRAWINGS

Figure 1:
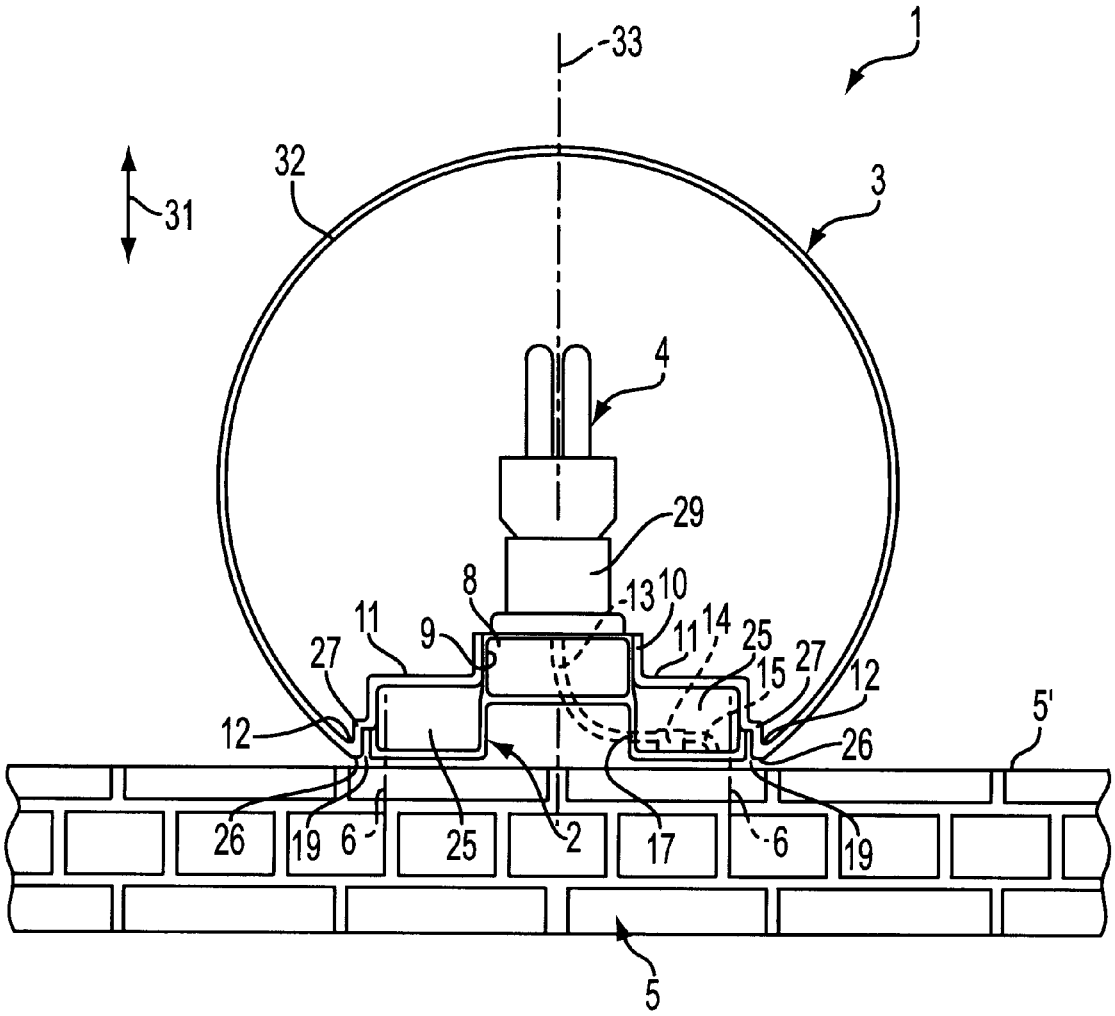
FIG. 1 Shows a diagrammatic side view of a first embodiment of a lighting device mounted on a stone wall.
Figure 4:
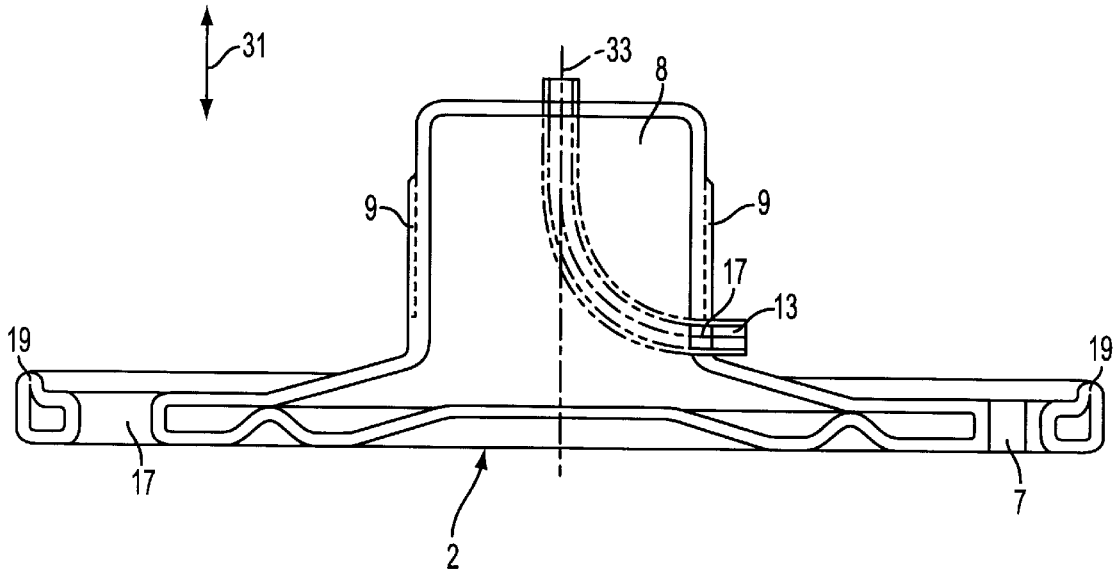
FIG. 4 Shows the sectional side view of the light holder according to FIG. 1.

The lighting device 1 according to FIG. 1 has a flat, cylinder-shaped light holder 2, a sphere-shaped light protector 3 and a light source 4 that is designed as economy light. The holder 2 is positioned and fastened on the wall surface 5' of a stone wall 5, serving as mounting support. Several fastening screws 6, indicated by dash-dot lines, are used for the fastening. FIG. 1 shows only two such fastening screws 6. Each fastening screw 6 extends through a hole 7 (see FIG. 4), coordinated with it, in the outer radial region of light holder 2 and is then secured in the stone wall 5. The wall surface 5' can enclose either a pointed or right angle with the horizontal line, in a manner not shown in further detail here. Thus, the mounting support 5 can, for example, also be a vertical building wall. The light protector 3 and the light holder 2 essentially have a rotation-symmetrical design, relative to a symmetry axis 33 or a center longitudinal axis, extending parallel to the axial direction 31. The light protector 3 is fitted in axial direction 31 onto the light holder 2 and is then screwed together with the light holder 2 by turning the light protector 3 in circumferential direction crosswise to the axial direction 31. For this, a holder top 8 is arranged in the central region of light holder 2. The holder top 8 that is arranged centered to the symmetry axis 33, has a cylindrical cross section and has a holder thread 9 in the form of an outside thread on its cylinder-shaped casing. The holder thread 9 cooperates with a complementary protector thread 10 in the form of an inside thread of light protector 3, so that after the light protector 3 is fitted on, it can be screwed together with the light holder 2. The protector thread 10 is also arranged centered to the symmetry axis 33. The thread end of protector thread 10, which faces the light holder 2 in axis-longitudinal direction is connected in circumferential direction of light holder 2 and with the aid of a ring-shaped, self-contained connecting crosspiece 11 to the protector wall 32 of light protector 3 that is effective as a covering. A plurality of strut-like connecting crosspieces can also be provided in place of this connecting crosspiece 11.

A protector collar 12 (e.g. see FIG. 5), which is self-contained and ring-shaped in circumferential direction of the light holder 2 and has an approximately wedge-shaped cross section is formed at the connection and transition location between the radial outer region of the connecting crosspiece 11 and the protector wall 32. During the assembly of the light protector 3, this protector collar 12 accommodates the light holder 2, meaning the region of light holder 2 that is above the wall surface 5', in an approximately form-locking manner and encircles it completely, with the exception of a slight movement of play between protector collar 12 and wall surface 5'. While the light protector 3 is screwed in, the protector collar 12 and the cylinder-shaped casing for the light holder 2 serve as fixing and guide means for an operator-friendly assembly.

The protector collar 12 delimits a central, circular protector opening, the opening edge 26 of which has a slightly larger diameter than a holder edge 19 of light holder 2 that projects over the wall surface 5'. The opening edge 26 also forms a type of wedge tip of protector 12. A fitting ridge 27 that is tangent to the outside casing of the holder edge 19, as well as the region of protector wall 32 that is immediately adjacent to the opening edge 26 serve as wedge legs.

The protector collar 12 and the opening edge 26 of another embodiment are designed such that the fitting ridge 27 is connected to the protector wall 32 by means of a web that extends approximately parallel to the mounting surface of a mounting support in the assembled state. This is shown as example in FIGS. 10*a*–10*k*, with the aid of light protector 3 and the earth 16 that is effective as mounting support.

The fitting ridge 27 in the exemplary embodiments shown, which is connected to the protector wall 32 in the region of opening edge 16, always points toward the inside space of light protector 3.

Figure 2:
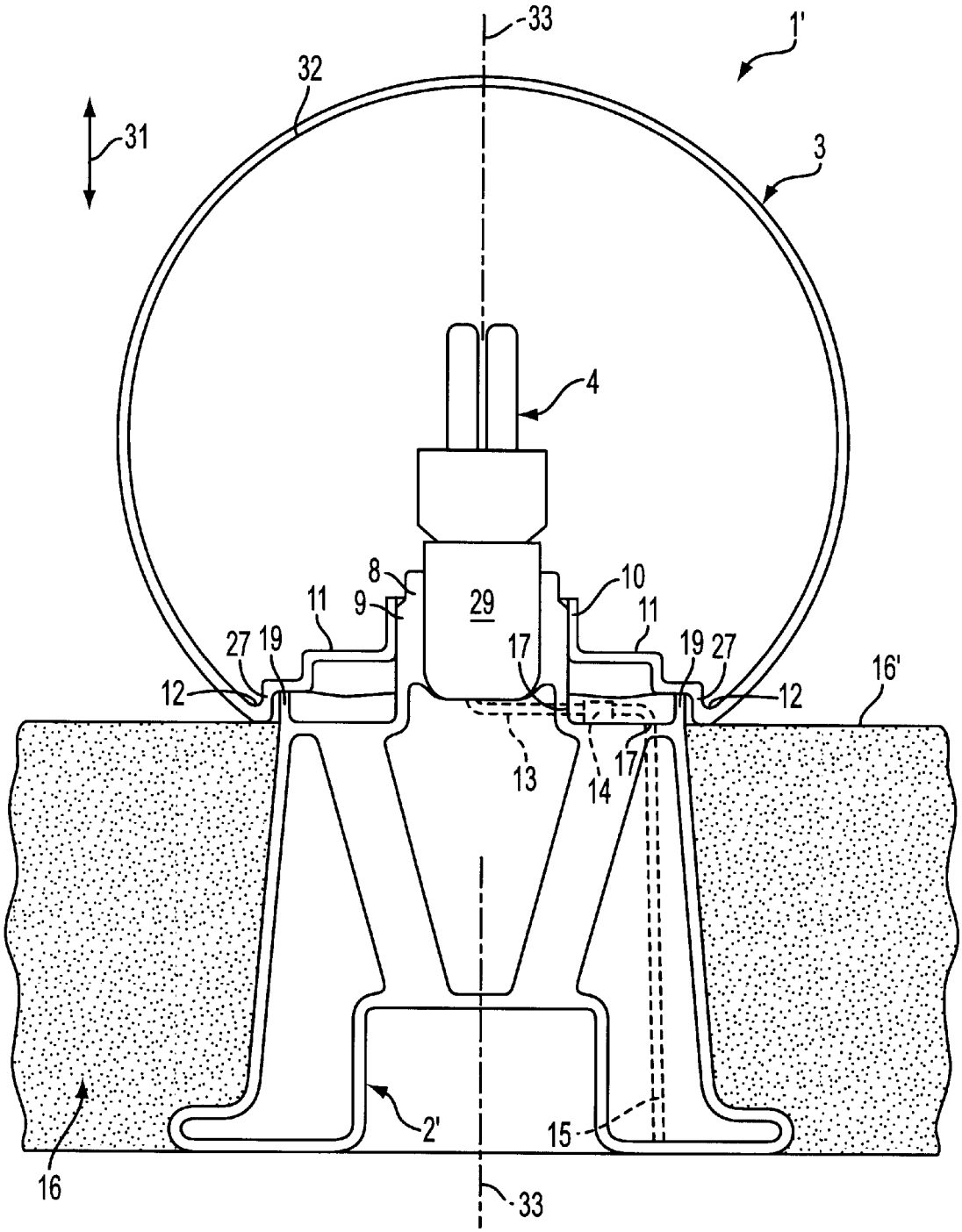
FIG. 2 Shows the schematic side view of the lighting device in a second embodiment that is inserted into the earth.
Figure 5:
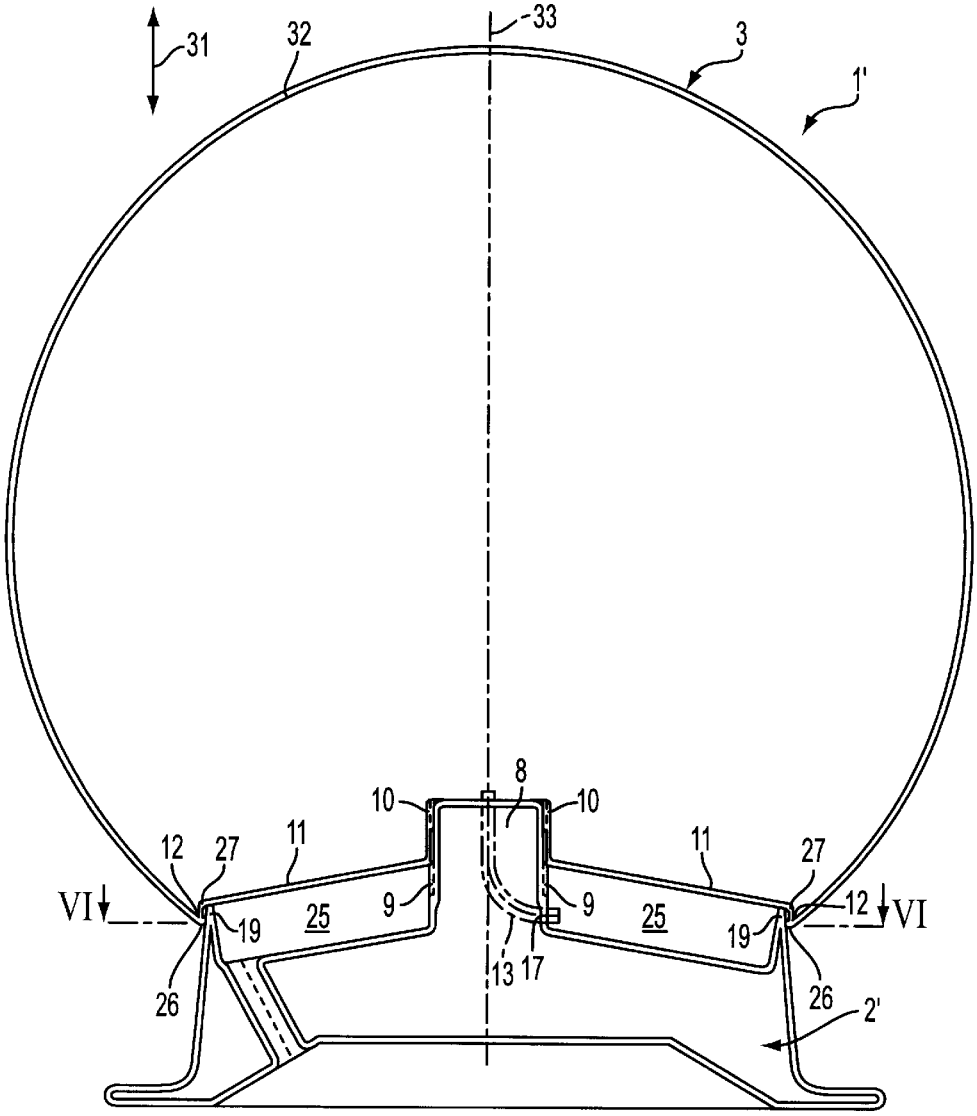
FIG. 5 Shows the sectional side view of a lighting device that approximates the embodiment according to FIG. 2.
Figure 6:
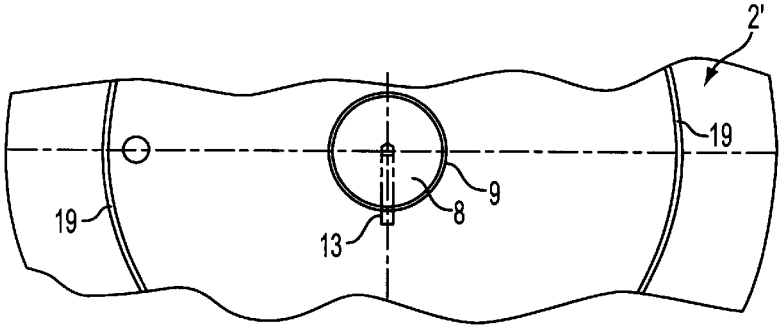
FIG. 6 Shows a partial view from above, along the line VI—VI in FIG. 5.
Figure 8:
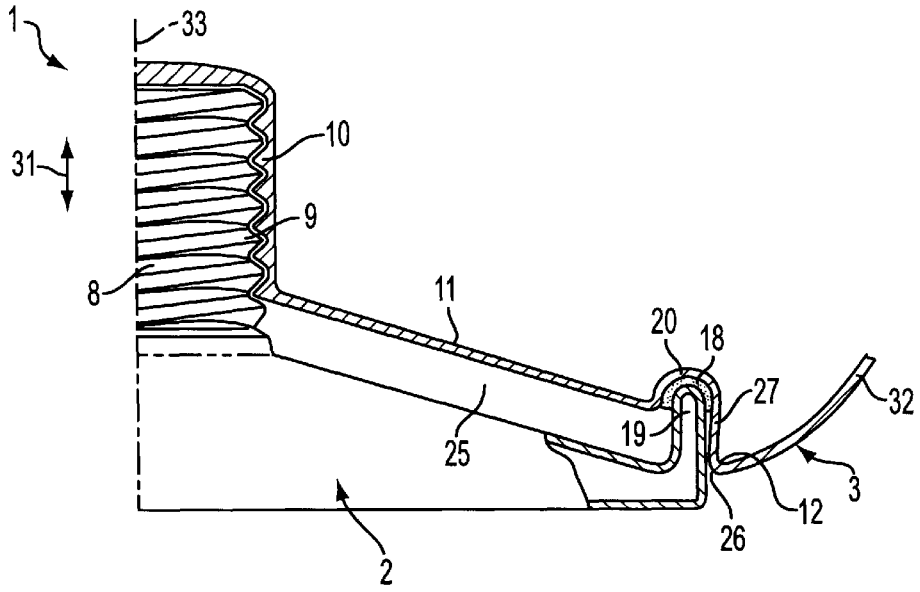
FIG. 8 Shows a schematic, detailed view of the lighting device according to FIG. 1.
Figure 9:
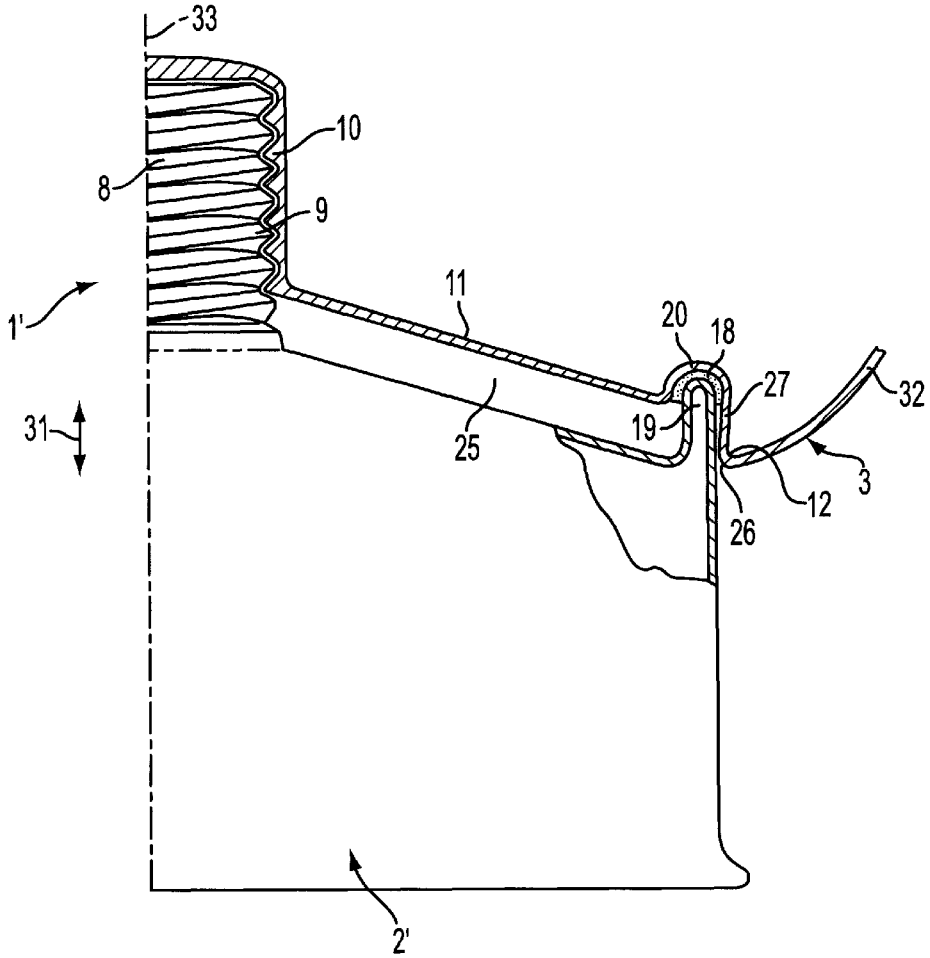
FIG. 9 Shows a schematic detailed view of the lighting device according to FIG. 2.

The lighting device 1' shown in FIGS. 2 and 5 differs from the lighting device 1 according to FIG. 1, above all by the axially higher design of light holder 2'. The higher design height of light holder 2' in FIGS. 2 and 5, as compared to the light holder 2 according to FIG. 1, serves to ensure a stable, non-tilting positioning of the lighting device 1' inside a lose mounting support, e.g. the earth 16 as mounting support. In FIG. 2, the light holder 2' is fitted into the earth 16 below the surface 16' that defines the mounting surface. The earth 16 surrounding the light holder 2' in the assembled state, replaces the fastening screws 6 used for the light holder 2 (FIG. 1) that is attached to the fixed mounting support 5.

In the assembled state of the lighting device 1, 1', the light protector 3 covers the light holder 2 or 2' in such a way that it is practically invisible. In that case, the surface area of protector collar 12 that faces the mounting support 5 or 16, is tangent to the mounting surface 5' or 16'.

Figure 3:
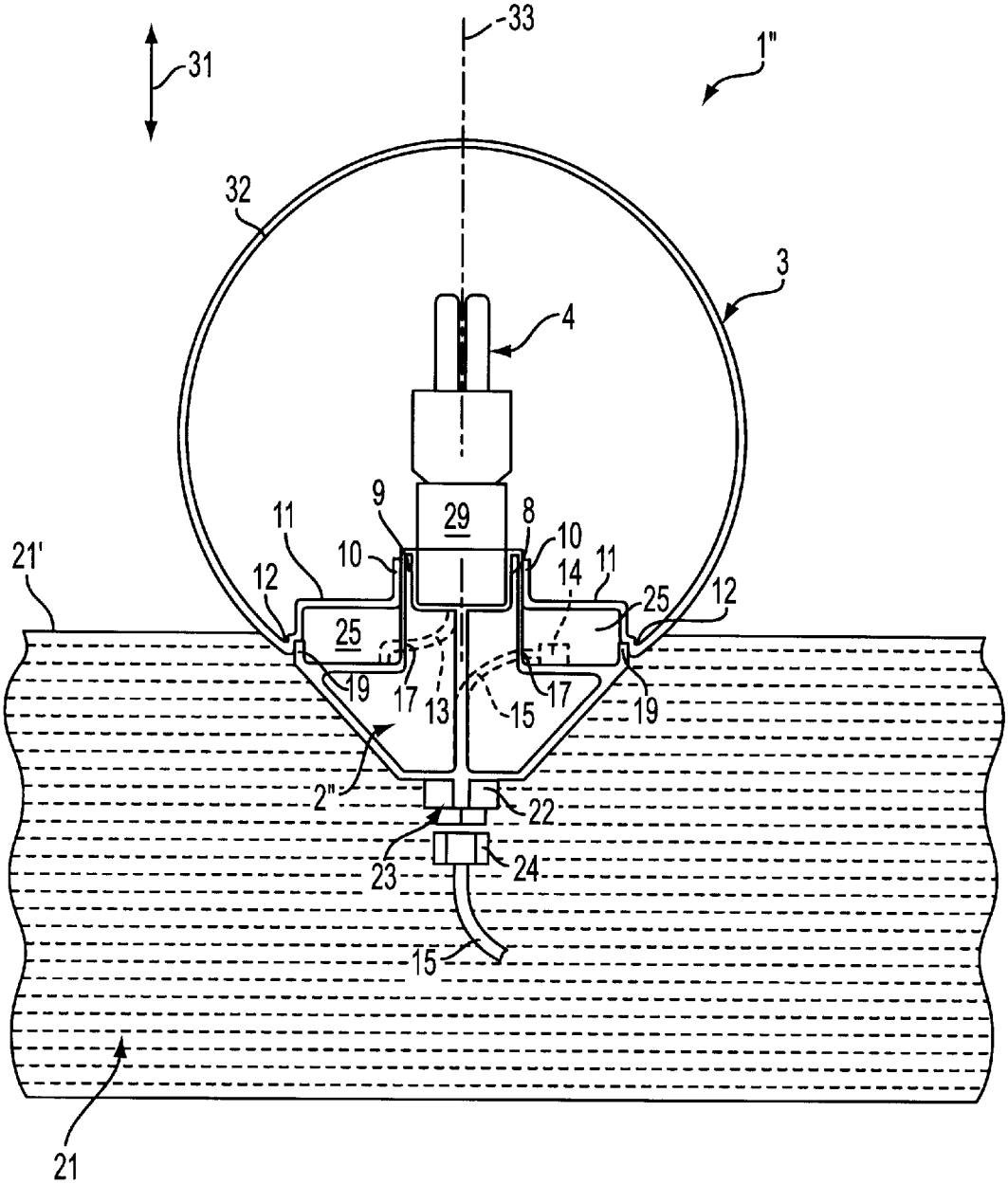
FIG. 3 Shows the schematic side view of the lighting device in a third embodiment, that is as a light floating in a liquid.
Figure 7:
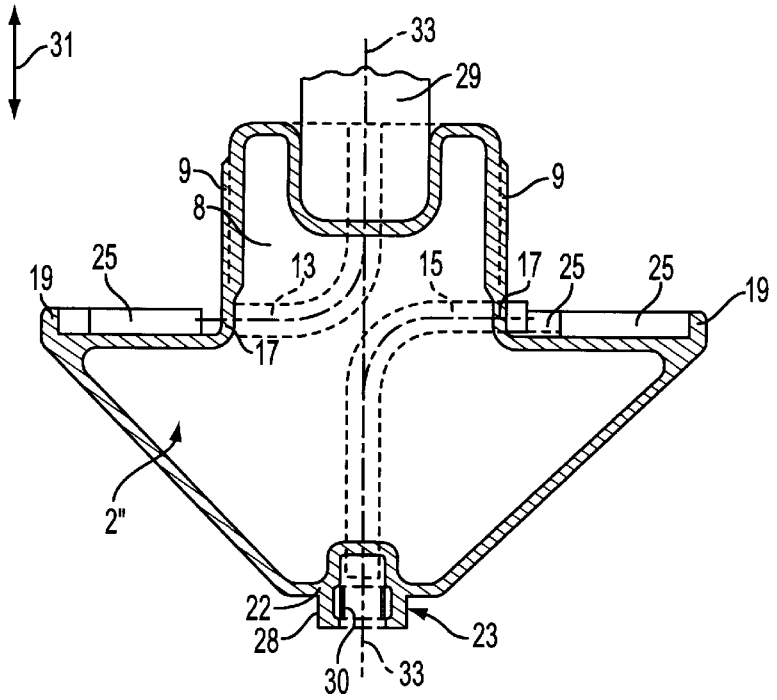
FIG. 7 Shows a sectional side view of the light holder according to FIG. 3.

For the exemplary embodiment according to FIGS. 3 and 7, the lighting device 1" is designed as a floating light. To be sure, the light holder 2" has a truncated cone shape and is designed for use under water or in another liquid 21. Nevertheless, the light protector 3 previously used for the lighting device 1 or 1' is also advantageously used here. With respect to its diameter, the holder edge 19 of light holder 2" is adapted to the corresponding diameter of holder edge 19 of light holder 2, 2' according to FIGS. 1 and 2, so that the same light protector 3 can be used for all illustrated embodiments of the light holders 2, 2", 2". Owing to the fact that the cone-shaped design of the light holder 2" is aligned with the form of light protector 3, it leads on the whole to a pear-shaped or drop-shaped form of the "floating light 1." This provides for a particularly stable, non-tilting positioning below a liquid surface 21' as mounting surface. Whereas the holder edge 19 and the protector collar 12 in the exemplary embodiment are located below the liquid surface 21', the holder top 8 projects over the liquid surface 21'. Thus, once the light protector 3 is fitted on, the holder region outside of the liquid 21 that is effective as mounting support and the light source are completely covered and not visible.

A previously manufactured electrical connecting line 13 for the light source 4 is integrated into the holder top 8. The connecting line 13 is electrically connected to a contacting socket 29. The light source 4 is inserted into and then screwed together with the contacting socket 29, thus establishing electrical contact with the connecting line 13. The contacting socket 29 is mechanically secured in the central region of holder top 8 and projects over the holder top 8 in the direction of light protector 3. By means of an electrical connector 14, e.g. a luster terminal or other contacting means, the connecting line 13 is connected to an external electrical supply line 15, which extends with one connection end into the light holder 2, 2', 2". One guide hole 17 or several guide holes 17 penetrate the holder top 8 and/or the light holder 2, 2' for a good arrangement of connecting line 13 and/or supply line 15. For the wiring of the lighting device, the connecting line 13 and/or the supply line 15 can be guided through these guide holes 17 to avoid uncontrolled wiring paths.

The contacting socket 29 is not shown in FIGS. 4, 5, 8 and 9 in order to simplify the drawings. Alternatively, other suitable structural elements that are not shown here can be fastened to the light holder 2, 2', 2" for the electrical contacting of light source 4.

The supply line 15 can be connected via its external connection end to the mains voltage or to a low-voltage source, e.g. a 12 V battery.

The electrical connector 14 as well as the line segments 13, 15 are fitted into a ring-shaped receiving channel 25 of light holder 2, 2', 2". This receiving channel 25 is essentially limited by the holder top 8, the connecting crosspiece 11 and the holder edge 19 and is thus sealed tightly toward the outside. Different cross sections of the receiving channel 25 are achieved by using varied connecting crosspieces 11. In FIGS. 1–3 and 10*a*–10*k*, the connecting crosspiece 11 has a step or staircase like design in the cross section, meaning crosswise to the circumferential direction of the light protector, whereas in FIGS. 5, 8, and 9 it has approximately the shape of a line.

FIG. 7 shows the truncated cone shape of the light holder 2" according to FIG. 3 in a side section. On an outside casing that serves as wrench surface 28 for securing a fork wrench, the light holder 2" has a formed-on thread extension 23 on its feeding end 22, positioned axis-longitudinally opposite the holder edge 19. A threaded connector 24 (see FIG. 3) that is screwed to the inside thread 30 of thread extension 23 compresses a seal, which is arranged in the region of the thread extension 23 and is not explicitly shown here. This seal serves to create a water-tight screw-connection and advantageously functions at the same time as pull relief for the supply line 15.

According to FIG. 7, the holder top 8 of light holder 2" in turn projects over the holder edge 19. As for the other embodiments of the lighting device, the receiving channel 25 formed between the holder edge 19 and the holder top 8 serves to receive and hold the electrical connector 14. In addition to the electrical connector 14, the holder top and holder edge may hold lines 13 and 15.

The option of being able to combine one and the same light protector 3 with various light holders 2, 2', 2" that are respectively adapted to special installation requirements is advantageous. In this way, the production of the total lighting device 1, 1' and its adaptation to different assembly requirements is possible at a low cost since a high degree of pre-production can be achieved. Making replacement parts available is also simplified. It is essential for combining the light protector 3 with different light holders 2, 2', 2" that the holder tops 8 and if need be the holder regions that are covered by the light protector 3 in the assembled state are structurally identical or have an identical design. When designing the remaining holder regions, only the special installation requirements of the respective mounting support must be considered for a simplification of the production technology.

Another embodiment of the lighting device 1, 1' is protected against penetrating moisture (FIGS. 8, 9) to improve its operational safety. In the assembled state, the lighting device 1, 1 has a ring-shaped sealing element 18 of plastic, rubber or the like for this, which in the cross section is bent approximately in a semicircular shape and is inserted in circumferential direction of the light holder 2, 2' between the protector collar 12 and the light holder 2, 2'. The sealing element 18 in this case fits form-fittingly onto the holder edge 19. As a result of the special shape of the sealing element 18, the light protector 3 according to FIGS. 8 and 9 has a circular-arc shaped protector groove 20 that ends in the fitting ridge 27 and is designed to accommodate the sealing element 18 in a form-locking manner and compress it. Of course, the lighting device 1" that is used as floating light can also be sealed by means of a sealing element, arranged between holder edge 19 and protector collar 12.

Figure 10A:
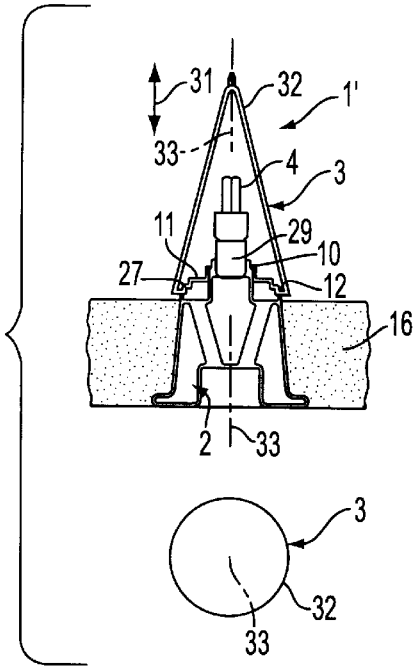
FIGS. 10*a*–10*k* Show various embodiments of the light holder in the assembled state, respectively in a view from the side and a view from above.

In the same way as one and the same light protector 3 can be used for different types of light holders 2, 2', 2", different types of light protectors 3, meaning different structural shapes, can be used for one and the same light holder. For this, only the region associated with the light holder, that is in particular the protector collar 12 and the protector thread 10, must be dimensioned identically for the various light protectors 3. This can be explained with the aid of FIGS. 10*a*–10*k*, wherein the light holder 2' is shown, but only as example for a light holder fitted into the earth 16. Rotation-symmetrical light protectors 3 are shown in FIG. 10*a*

Figure 10B:
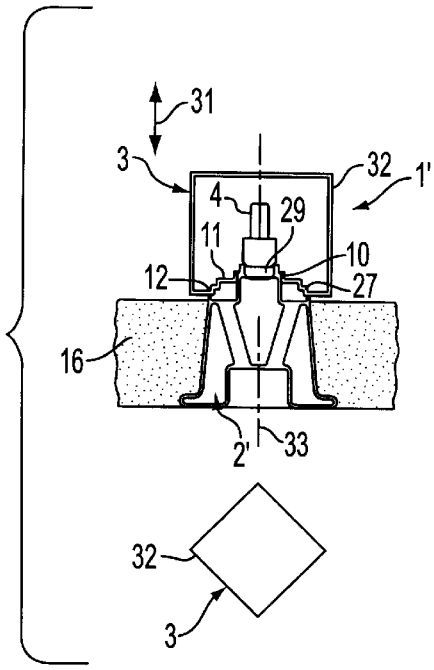
Figure 10C:
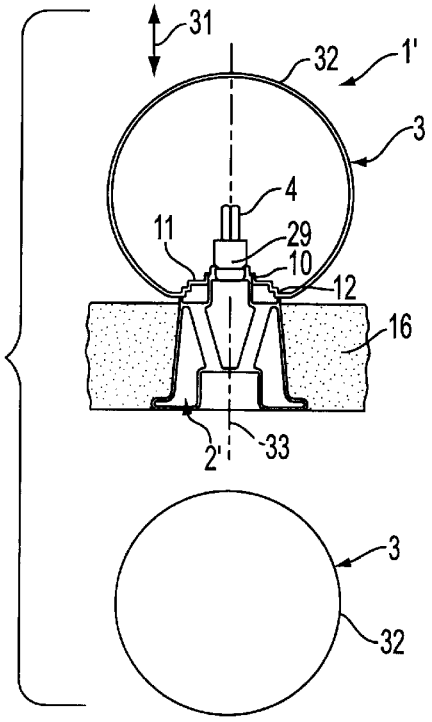
Figure 10D:
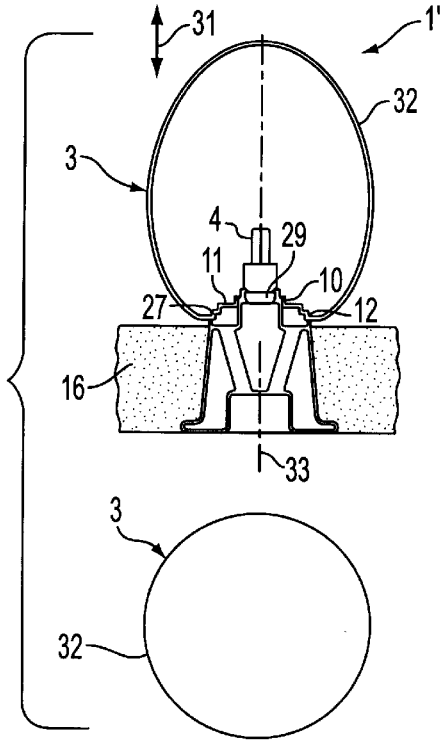
Figure 10E:
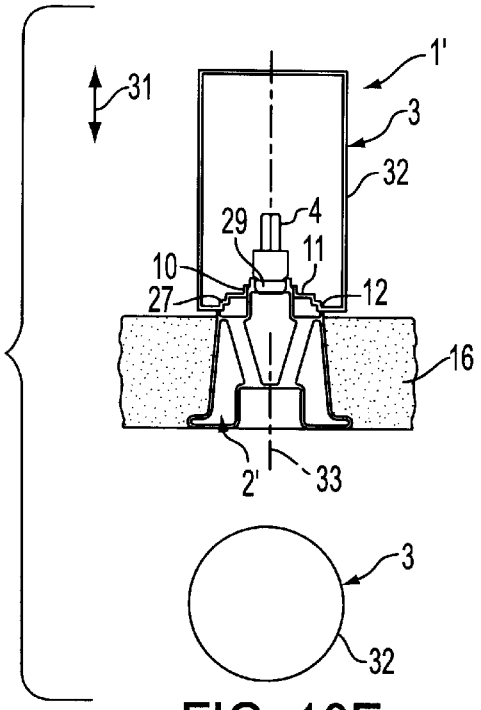
Figure 10F:
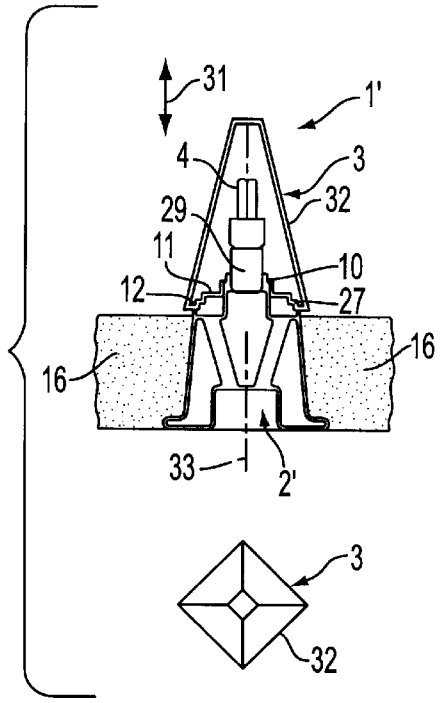
Figure 10G:
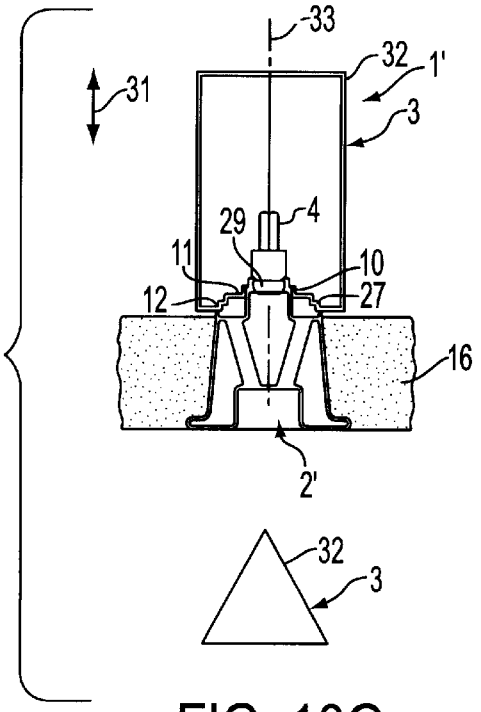
Figure 10H:
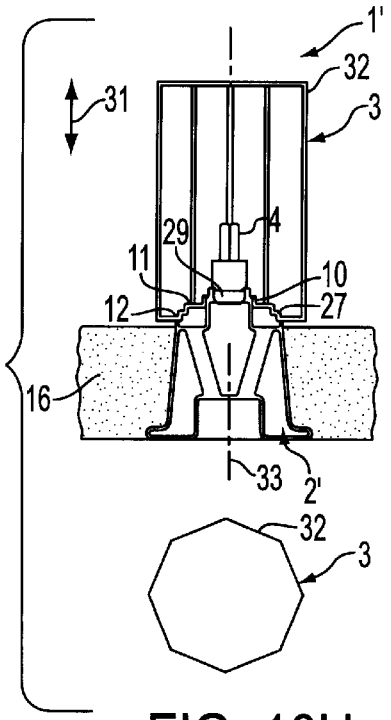
Figure 10I:
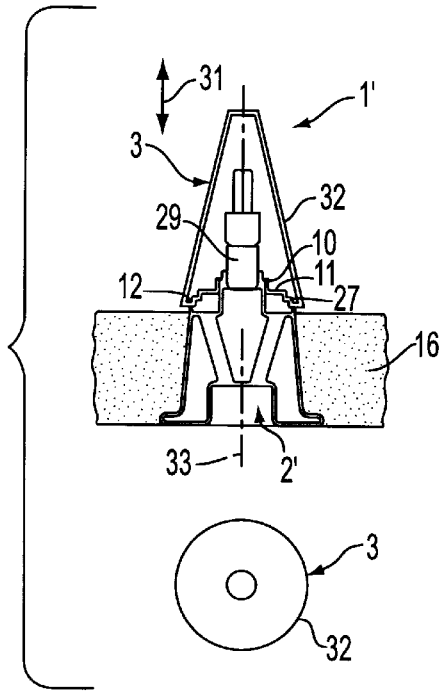
Figure 10J:
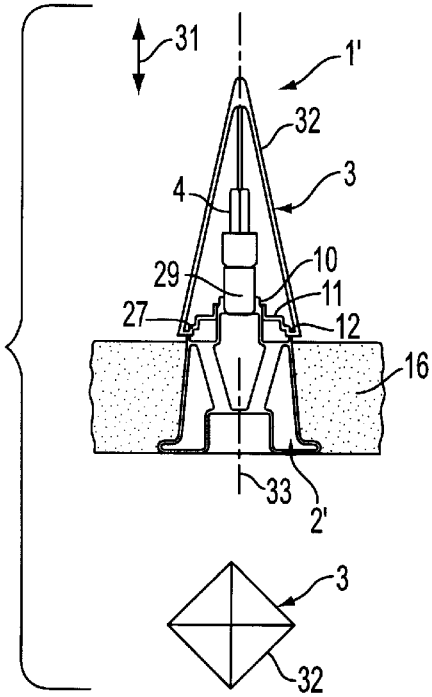
Figure 10K:
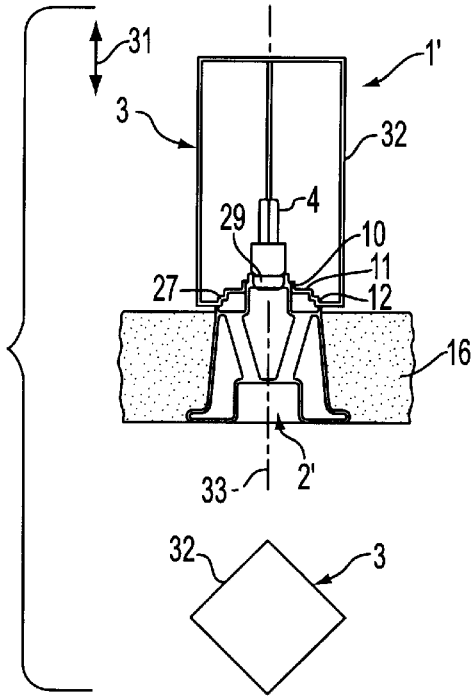

(cone-shaped), in FIG. 10*c* (ball-shaped), in FIG. 10*d* (eggshell-shaped), in FIG. 10*e* (cylindrical) and in FIG. 10*i* (truncated cone-shaped). Light protectors 3 having a polygonal cross section are shown in FIG. 10*b* and FIG. 10*k* (respectively square), in FIG. 10*g* (triangular) and in FIG. 10*h* (octagonal). FIG. 10*f* shows a truncated pyramid-shaped and FIG. 10*j* a pyramid-shaped light protector 3.

What is claimed is:

1. A lighting device comprising:

a light holder positionable on a mounting support and presenting an outer light holder edge, said light holder including:

a light holder top centrally located for fastening a light source that projects from the mounting support; and a light protector detachably fastened on the light holder and covering the light source and any holder regions projecting from the mounting support in such a way that essentially only the light protector is visible, wherein the light protector has a protector collar encircling the outer holder edge and defining a protector opening with a fitting ridge that is pointed inwardly towards the protector opening.

2. A device according to claim 1, wherein the light holder top has an outside thread, for engaging a complimentary light protector inside thread.

3. A device according to claim 2, wherein the light holder further includes, a connecting cross piece that extends across a central axis of the light protector and connects the protector thread to the protector collar.

4. A device according to claim 3, wherein the light protector has a circumference and the connecting cross piece is contained within the circumference of the light protector.

5. A device according to claim 1, wherein the protector collar encircles the outer light holder edge with a sealing element inserted in between.

6. A device according to claim 1, wherein the light protector has a one-piece design.

7. A device according to claim 1, wherein the light protector and lightholder have a rotation-symmetrical design.

8. A device according to claim 1, wherein the light protector is conically tapered in the direction of its side that is facing away from the mounting support.

9. A device according to claim 1, wherein the light holder is a cone-shaped or truncated cone-shaped, with a tapered cross section in the direction of the side that faces away from the light protector in an axial longitudinal direction.

10. A device according to claim 1, wherein the light holder is adapted to be inserted at least, in part, into the mounting support.

11. A device according to claim 1, further comprising:

a contacting socket attached to the light holder, and an electric light source that can be screwed together to form an electrical connection.

12. A device according to claim 11, wherein the light holder top has a casing and a holder thread formed onto the casing of the light holder top, and the contacting socket is fastened to the light holder top and is centrally arranged to the holder thread.

13. A device according to claim 3, wherein the light holder has at least one receiving channel for receiving an electrical line, which can be connected between an energy supply source and at least one of the light source and a contacting socket.

14. A device according to claim 13, wherein the at least one receiving channel is formed between the connecting cross piece and the light holder.

* * * * *